United States Patent [19]

Frank et al.

[11] Patent Number: 4,614,091

[45] Date of Patent: Sep. 30, 1986

[54] PROCESS AND DEVICE FOR COOLING IN CONTAINERS

[76] Inventors: Martin Frank, Frankenforster Strasse 8, 5060 Berg. Gladbach 1; Klaus Plassmeier, Vordersten Büchel 61, 5064 Rösrath (Hoffnugsthal), both of Fed. Rep. of Germany

[21] Appl. No.: 733,571

[22] Filed: May 13, 1985

[30] Foreign Application Priority Data

May 30, 1984 [DE] Fed. Rep. of Germany ..... 3420256

[51] Int. Cl.[4] ..... F25D 3/12

[52] U.S. Cl. ..... 62/384; 62/119; 165/104.21

[58] Field of Search ..... 62/384, 119; 165/104.21

[56] References Cited

U.S. PATENT DOCUMENTS 3,475,918 11/1969 Burton ..... 62/384
3,783,633 1/1974 Glynn ..... 62/384
3,788,091 1/1974 Miller ..... 62/384
3,906,744 9/1975 Knapp et al. ..... 62/384

*Primary Examiner*—Ronald C. Capossela
*Attorney, Agent, or Firm*—Browdy and Neimark

[57] ABSTRACT

Process and Device for heat removal from the effective area of a cooling container with the application of dry-ice as cooling agent, where a refrigerant (e.g. FREON) is circulated in a closed pipe system.

According to the construction and degree of charge the gravity cooling system (thermosyphon) or evaporation principle with natural circulation is used to take up the heat from interior space and to supply it to dry-ice as heat of sublimation.

The systems of heat transfer are arranged in such a way that even for the inclined cooling container, e.g. at the time of aircraft take-off, at least half of the diagonally arranged heat transfer systems in the interior part are fully active to provide sufficient cooling.

8 Claims, 6 Drawing Figures

Fig.1
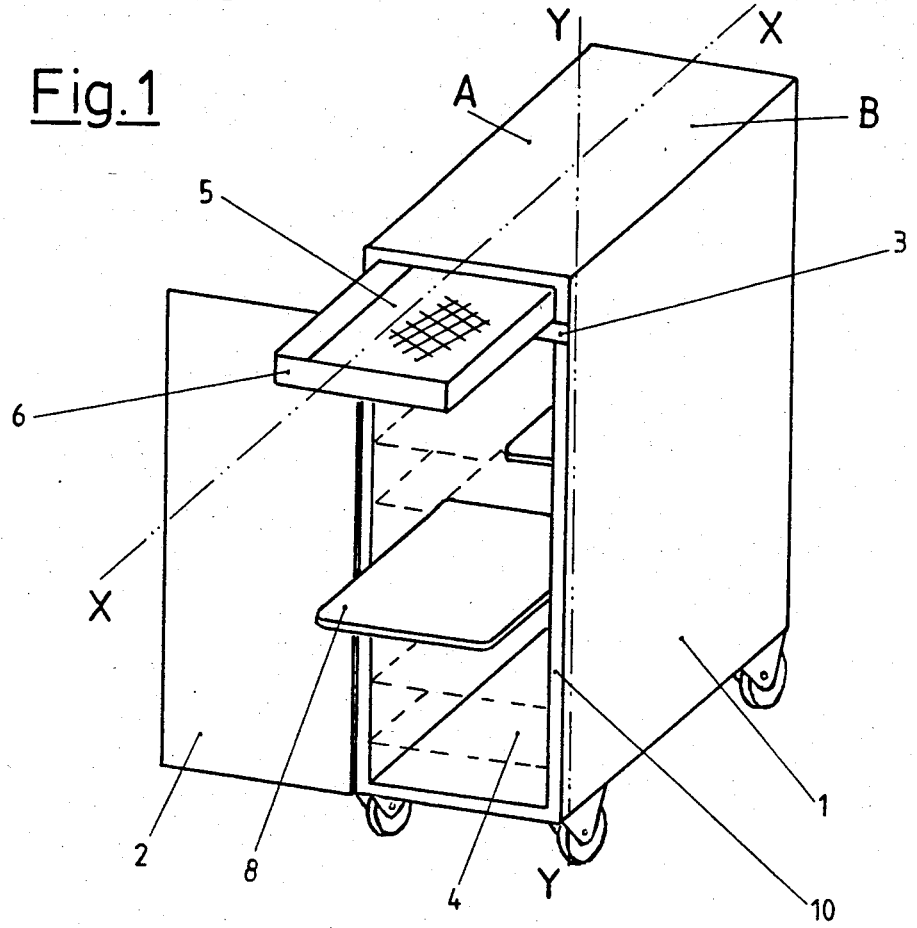
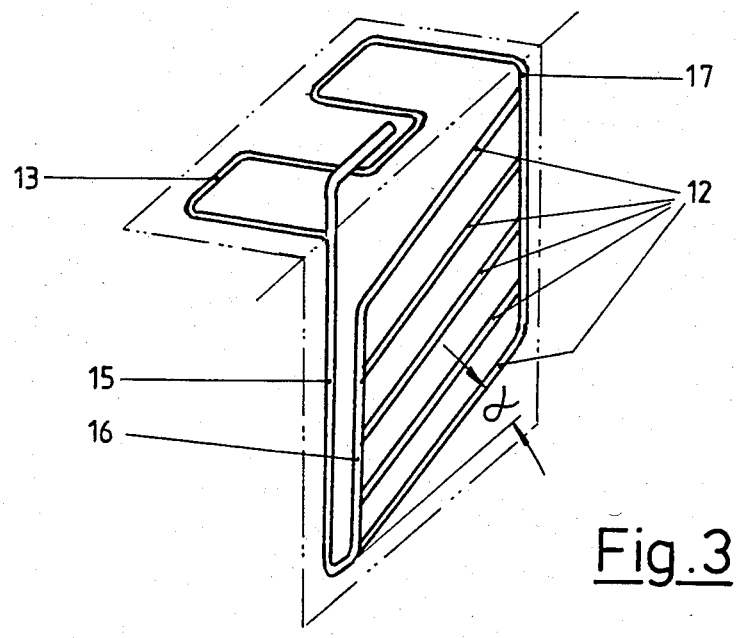
Fig.3

Fig. 2a
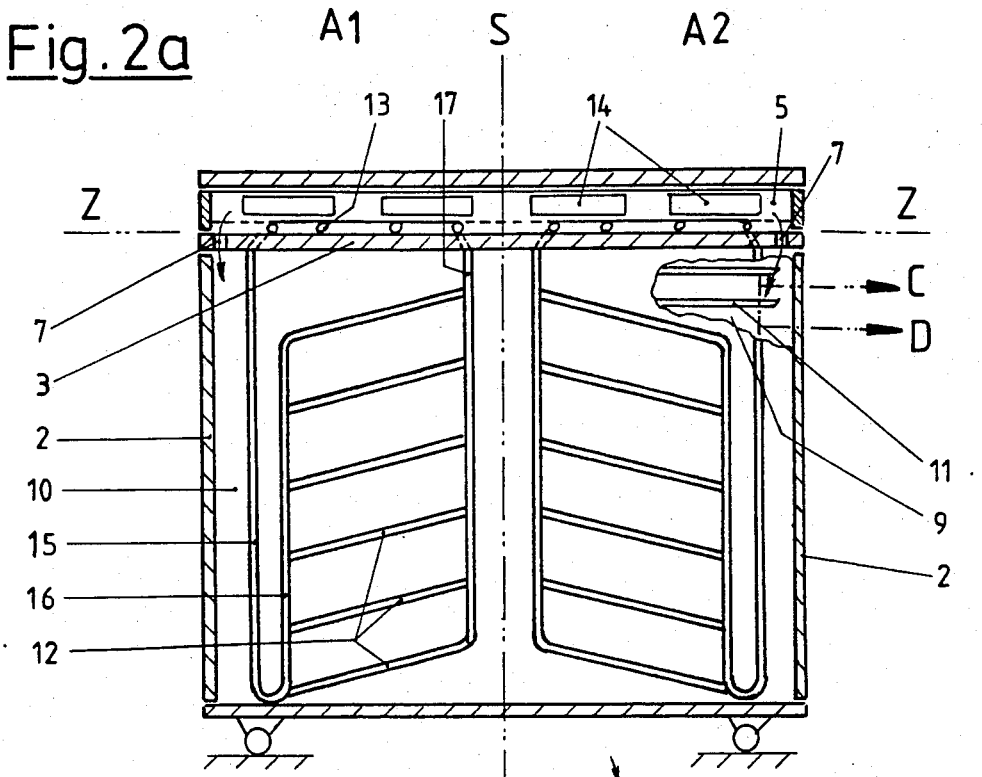
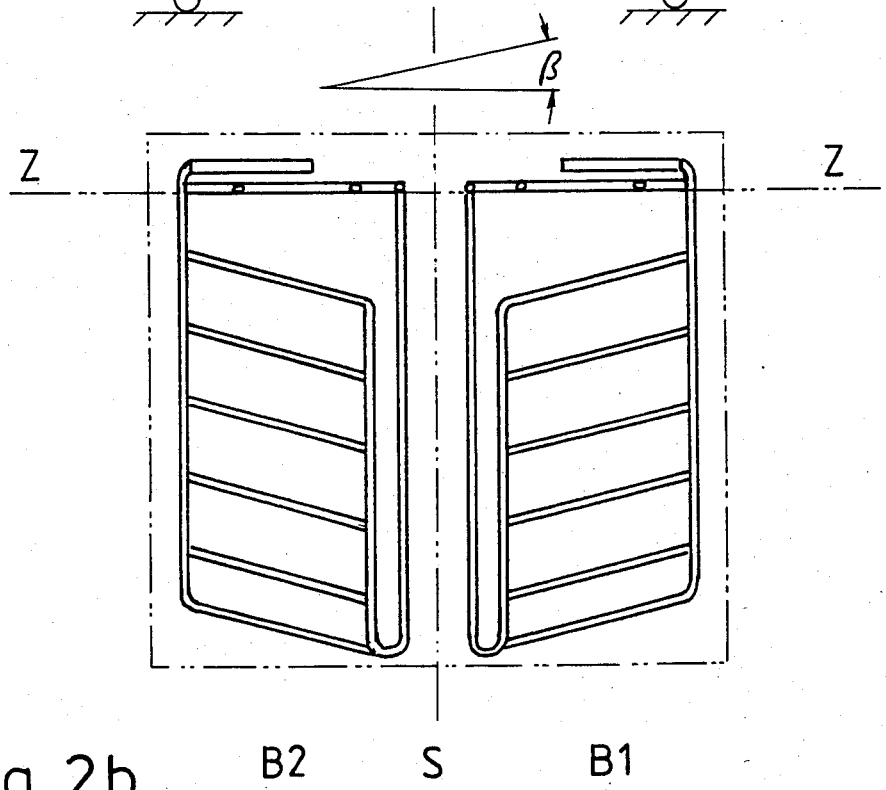
Fig. 2b

Fig.4
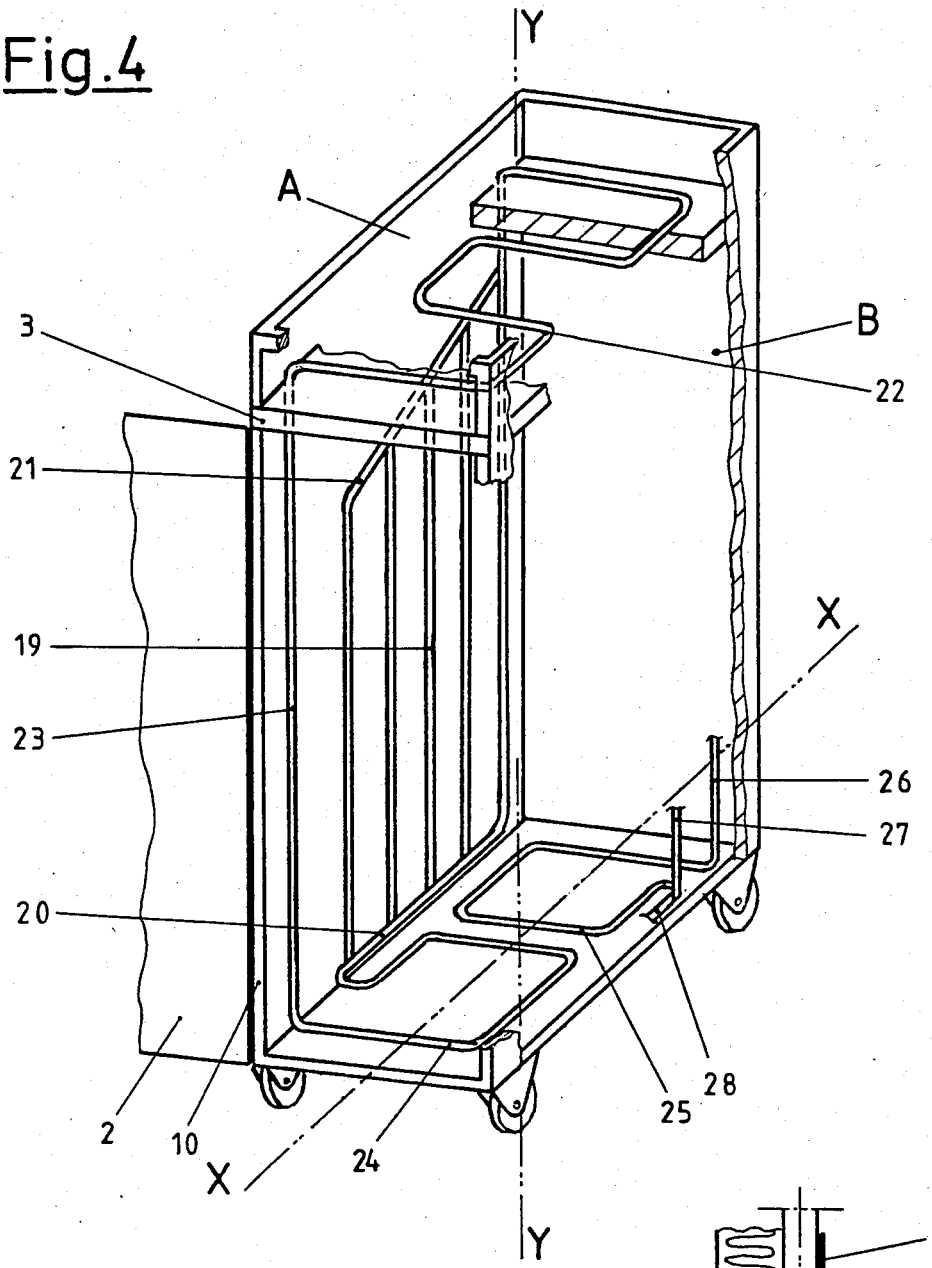
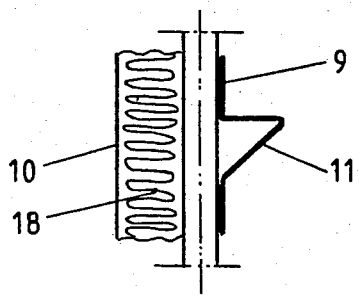
Fig.5

PROCESS AND DEVICE FOR COOLING IN CONTAINERS

For cooling of foodstuffs are ready-made meals, especially for passengers in air-traffic, mobile containers, trolleys or meal carts, are used.

These contain 26 to 30 trays with meals stored in a galley till service time.

The cooling of the contents is done with the help of dry-ice, $CO_2$ in solid state, and/or with cooling air. The use of dry-ice in the trolley is advantageous because of its movability without connecting it to a refrigerator. It plays an important role in its transportation from the service station to the aircraft as well as in unwanted and unavoidable delay.

These containers are constructed in such a way that dry-ice, which sublimates at a temperature of below −78° C. (195 K.) in a $CO_2$ containing atmosphere, is used in form of pellets or plates and is arranged in the drawer of the upper section of the device. It is separated from the effective area, where a temperature above freezing point of water should be maintained with the help of a heat insulation plate. Slits are made in this plate which continue downwards to form vertical channels in the wall. The openings in the narrow sides of the drawer to the doors, also help in forming the connection to the interior space.

The dry-ice takes the heat of sublimation especially from its surroundings outside the effective area.

The cold $CO_2$-gas with a density approximately double that of the air flows along the outer walls into the interior, thus cooling the contants. For this arrangement and adequate thermal insulation between dry-ice drawer and effective area is important to control the effect of the heat transfer to the upper levels.

The degree of cooling in the lower levels is insufficient because the cooling gas gets warm along the walls till it reaches the bottom area.

It is generally known that the heat absoprtion $\dot{Q}_{Gas}$ of a mass flow is related to its temperature difference ($T_2$-$T_1$). In this case the cooling mass flow is insufficient to cover the heat transfer through the walls.

$$\dot{Q}_{Gas} = \dot{m} \cdot c_{pmCO_2} \cdot (T_2 - T_1) = \dot{Q}_T c_{pmCO_2} \text{ (kJ/kg} \cdot \text{K)}$$

is the mean specific heat of the cooling gas in the temperature field in question.

The cooling gas mass flow can not be increased at random because of the conception of the containers used. In addition the heat of sublimation is taken from the space and surfaces, which are in fact not taking part in the cooling purpose, e.g. the top covering plate of the container. It causes the presence of unwanted temperature gradients and heterogeneous temperatures in the interior of the container.

A constant temperature field in the effective area is achieved by using a cooling agent which is circulated in a closed circuit and is moved through the heat exchange from the dry-ice, whereas the dry-ice takes its heat of sublimation from the effective area. It can be obtained by the use of heat transport media in the form of common cooling agents which absorb the heat according to the boundary conditions from the effective area:

(a) according to the gravity cooling system (thermosyohon-priciple) through the heating up of the agent, or (b) according to the natural-circuit evaporation principle at a constant temperature.

FREON R 12 is to be recommended here as cooling agent which has a vapor pressure of $p_o$=3.09 bar at 0° C. and in case of hot cleaning of the container at 80° C. the vapor pressure is $p_1$=23.2 bar.

By the use of R 12 and dry-ice in form of plates or pellets a temperature field with a very narrow range of 3°–4° C. in the container is achieved.

The advisable solution in case of a particular cooling container for ready-made meals in air-traffic should be explained under the consideration of existing conditions.

cf. the drawings:

FIG. 1 Cooling container with open door and partially pulled out dry-ice drawer and trays, FIG. 2 Device for the gravity cooling system (a) cross section through the container in the x-y level, sectional half A with the gravity cooling system A 1 and A 2, and (b) arrangement of gravity cooling system B 1 and B 2 in the sectional half B, FIG. 3 Representation of the device as perspective sketch with the example of B 1 according to FIG. 2*b*, FIG. 4 Device for the use of natural evaporation principle, FIG. 5 Cross section according to C-D in FIG. 2 a through the side wall of the container.

Cooling container of a common type with open door is shown in FIG. 1. The mobile container (1) with a door (2) on the either side of narrow walls, is separated through a heat insulated wall (3) in the effective area (4) for the contents and the section (5) for the drawer (6) which covers the total depth of the container or can be used in two parts. These drawers with perforated bottom contain dry-ice whereas the sublimated $CO_2$-gas flows down into the effective area through the slits (7) of heat insulation wall (3), as shown in FIG. 2*a*. The cold gas take up heat mainly from the upper area and forms a $CO_2$-gas-air-mixture in the entire effective area which provides a protection in the bacteriostatic atmosphere for unsealed meals.

The effective area (4) of the container described is divided into many compartments in which the trays (8) containing meals or drawers for other contents are arranged. FIG. 1 shows a section through the container in the x-y level.

The sectional half is demonstrated in FIG. 2*a*. In FIG. 2*b* of the sectional half B the pipe system of the device is shown in a simplified form, which is transfered along the symmetric axis S-S. It gives the complete arrangement of the cooling system around the effective area.

To explain the process and device, in FIG. 2*a* the preferably metallic layer (9) of side wall (10) with beads (11) is removed.

The cooling systems are in pair (very similar to each other) and of the same type, i.e. A 1 and B 1 as well as A 2 and B 2 and are arranged symmetrically in the side walls (10).

In FIG. 3 the cooling system is demonstrated as dimetric illustration showing the main construction of system B 1. The arrangement of the pipes in the side wall (10) is shown in FIG. 5 as a section according to C-D (FIG. 2*a* ).

The pipe system in FIG. 3 demonstrates the device for the execution of the gravity cooling system. It consists of a ladder type tube arrangement in the side wall with parallel-arranged pipes at an angle $\alpha$ (12). Moreover, it is composed of horizontally lying serpentined pipes (13) and a filling valve which is not further explained. The whole pipe system is filled with a cooling medium.

The dry-ice (14) is placed above the serpentined pipe as shown in FIG. 2*a*.

Through the cooling down, the cooling agent moves through the down-pipes (15) spreading in the parallel, inclined pipes (12) via the rising tube (16) and circulates the warmed-up cooling medium, in which vapor may exist, to the collecting pipe (17) and back to the serpentined pipe (13).

The pipes in the vertical plane (12; 15; 16; 17) as shown in FIG. 5 are embedded in the thermal insulation layer (18) of the side wall (10) and touche the interior metallic wall (9) with tray supports (11) which conducts heat and works as a heat transfer surface.

For containers of these measurements (appr. 1 m×1 m×0.35 m) the cooling system is composed of e.g. copper tubes 6×1 mm DIN 1786. This pipe has a maximum allowable operating pressure of $p_{max}=138$ bar according to DIN 2413, which is very far above the vapor pressure of FREON R 12, which may be reached, for example, when cleaning the container at 80° C.

Similarly because of weight reasons, the device can be made out of material resistant to cooling agents.

The symmetrically arranged cooling system shown in FIGS. 2*a* and 2*b* effects that at the time of inclined position of the container e.g. at aircraft taking-off, the function of the system is not affected much. At taking-off, for example, as angle $\beta$ between FIGS. 2*a* and 2*b* indicates, the inclination of the pipes (12) of system A 1 and B 1 increases and its function, however, remains as such. The function of system A 2 and B 2 can be weakened by means of decreasing the pipe inclination.

For such temporary phases with increased inclinations in both directions, two systems lying diagonally opposite are in full function and the cooling of the effective area is guaranteed.

Without deviating from the invention idea the pipes (12) can be arranged on the interior wall (9) and work as tray supporters at the same time.

In FIG. 4 a second solution is demonstrated, which consists of an evaporator with natural circulation arranged in the vertical side wall (10) and a condenser place above the separation wall (3).

FIG. 4 shows a container with open front door (2), the side wall of part B is broken, the top plane of the container (1) and the dry-ice drawer (6) are removed to demonstrate the part A of FIG. 1. The evaporation pipes (19) are arranged vertically and connected by means of a distribution pipe (20) at the bottom of the container and end in an inclined vapor collecting pipe (21) forming the connection with the serpentined pipe (22).

This pipe system is filled with a cooling medium up to approximately 80% of the evaporator-hight. A cooling mechanism covering the complete effective area is obtained by means of a special arrangement of the down-pipe (23) connected to a loop (24) in the bottom layer of the container.

In the same manner, the bottom of the container can be constructed as a heat exchanger surface in the form of a plate-heat-exchanger, likewise the systems of FIGS. 2*a* and 2*b* and FIG. 4 can be designed in the vertical walls.

The cooling system of the broken side B of the container represents the loop (25) in the bottom layer and the connections for the down-pipes (26), the evaporator pipe (27) and the connecting pipe (28) to all evaporation pipes in part B of the container. Thus, the sidewise-interchangeable arrangement of both the systems in parts A and B is characterized. It again proves advantageous in the inclined position of the device as, for example, at the time of the taking-off and landing of the aircraft, as already explained in the first solution.

The evaporator-condensor-system can be divided into two independent systems in each wall as in the case of the gravity cooling system demonstrated in FIGS. 2*a* and 2*b*.

The arrangement is to be symmetrical so that in one wall such as e.g. part A of the container, the collecting pipe (12) descends from the middle of the wall in the direction of the door and ascends on the opposite side.

We claim:

1. A cooling container comprising a housing having vertical side walls, a top, and a bottom;

a heat transfer circuit having vertical elements and horizontal elements, the vertical and horizontal elements having a cooling fluid therein;

solid carbon dioxide in direct thermal contact with the horizontal element for transferring heat thereto to condense the fluid in the heat transfer circuit;

the vertical element having branch pipes positioned at an angle to the vertical element to transfer heat from the articles to be cooled;

whereby a thermosyphonic flow of cooling fluid is established.

2. The container of claim 1 wherein the cooling agent is FREON R12.

3. The container of claim 1 wherein the solid carbon dioxide is in the form of pellets.

4. The container of claim 1 wherein the solid carbon dioxide is in the form of plates.

5. The container of claim 1 wherein the container is divided into compartments containing drawers.

6. The container of claims 1 wherein the branch pipes are arranged parallel to each other.

7. The container of claims 1 wherein the vertical element is embedded in a thermal insulation layer of the side walls.

8. The container of claim 1 wherein trays are supported on the branch pipes.

* * * * *